US010741919B2

(12) United States Patent
Suzuki

(10) Patent No.: US 10,741,919 B2
(45) Date of Patent: Aug. 11, 2020

(54) ANTENNA DEVICE

(71) Applicant: Murata Manufacturing Co., Ltd., Nagaokakyo-shi, Kyoto-fu (JP)

(72) Inventor: Yusuke Suzuki, Nagaokakyo (JP)

(73) Assignee: MURATA MANUFACTURING CO., LTD., Nagaokakyo-Shi, Kyoto-Fu (JP)

( * ) Notice: Subject to any disclaimer, the term of this patent is extended or adjusted under 35 U.S.C. 154(b) by 0 days.

(21) Appl. No.: 16/676,946

(22) Filed: Nov. 7, 2019

(65) Prior Publication Data

US 2020/0136254 A1 Apr. 30, 2020

Related U.S. Application Data

(63) Continuation of application No. PCT/JP2018/017642, filed on May 7, 2018.

(30) Foreign Application Priority Data

May 25, 2017 (JP) ..... 2017-103815

(51) Int. Cl.

| | |
|---|---|
| ***H01Q 7/08*** | (2006.01) |
| ***H01Q 7/00*** | (2006.01) |
| ***H01Q 1/42*** | (2006.01) |
| ***H01Q 1/22*** | (2006.01) |

(52) U.S. Cl.

CPC ..... *H01Q 7/08* (2013.01); *H01Q 1/22* (2013.01); *H01Q 1/42* (2013.01); *H01Q 7/00* (2013.01)

(58) Field of Classification Search

CPC .. H01Q 7/08; H01Q 1/42; H01Q 1/22; H01Q 7/00

USPC ..... 343/872

See application file for complete search history.

(56) References Cited

U.S. PATENT DOCUMENTS

| | | | | |
|---|---|---|---|---|
| 7,545,336 | B2 * | 6/2009 | Naito | G06K 19/07749 343/788 |
| 2007/0075913 | A1 * | 4/2007 | Moriya | H01Q 7/06 343/895 |
| 2012/0176215 | A1 * | 7/2012 | Kudo | H01Q 1/40 336/221 |

(Continued)

FOREIGN PATENT DOCUMENTS

| | | | |
|---|---|---|---|
| JP | 2009278274 | A | 11/2009 |
| JP | 2014225834 | A | 12/2014 |
| JP | 2016100609 | A | 5/2016 |

OTHER PUBLICATIONS

International Search Report issued for PCT/JP2018/017642, dated Jul. 10, 2018.

(Continued)

*Primary Examiner* — Hai V Tran

(74) *Attorney, Agent, or Firm* — Arent Fox LLP

(57) ABSTRACT

An antenna device is provided that includes an antenna coil, a resin-made antenna case having a body that accommodates the antenna coil, and a rib disposed on an upper surface of the body and on a pair of opposing side surfaces. In the antenna case, the rib is continuously formed from one of the side surfaces, across the upper surface, to the other one of the side surfaces, and both ends of the rib are formed to be flush with a lower surface of the body or so as to extend downward from the lower surface of the body. In addition, both ends of the rib are designed to come into contact with an external member when the antenna device is mounted on the external member.

20 Claims, 8 Drawing Sheets

(56) References Cited

U.S. PATENT DOCUMENTS

| | | | | |
|---|---|---|---|---|
| 2014/0361949 | A1* | 12/2014 | Mahara | H01Q 1/1207 343/866 |
| 2015/0124409 | A1* | 5/2015 | Kawano | H05K 7/20472 361/715 |
| 2015/0295315 | A1* | 10/2015 | Tanaka | H01Q 1/32 343/788 |
| 2017/0301995 | A1* | 10/2017 | Tanaka | H01Q 1/2208 |
| 2018/0159224 | A1* | 6/2018 | Inoue | H01Q 7/08 |
| 2019/0097322 | A1* | 3/2019 | Suzuki | H01Q 1/085 |

OTHER PUBLICATIONS

Written Opinion of the International Searching Authority issued for PCT/JP2018/017642, dated Jul. 10, 2018.

* cited by examiner

ANTENNA DEVICE

CROSS REFERENCED TO RELATED APPLICATIONS

The present application is a continuation of PCT/JP2018/017642 filed May 7, 2018, which claims priority to Japanese Patent Application No. 2017-103815, filed May 25, 2017, the entire contents of each of which are incorporated herein by reference.

TECHNICAL FIELD

The present invention relates to an antenna device having an antenna coil to be used for transmission and reception of radio waves.

BACKGROUND ART

Currently, an existing example of antenna device is disclosed in Patent Document 1 (Japanese Unexamined Patent Application Publication No. 2016-100609). Patent Document 1 discloses an antenna device that includes an antenna coil, a resin-made antenna case having a recess for accommodating the antenna coil, and a filler for sealing the antenna coil accommodated in the recess.

For example, a vehicle-mounted antenna device used for a smart keyless system or the like is typically mounted on a metal plate of a vehicle body by using a fastening member, such as a screw or a clip. In this case, if the antenna device is mounted where the device is stepped on, a load exceeding 100 kg, for example, may be applied to the antenna device.

To address this concern, the known antenna device has a thickness of the antenna case that is increased so as to improve the load bearing capability. However, increasing the thickness of the antenna case requires an increased amount of resin, which leads to an increase in weight and manufacturing cost of the antenna case.

SUMMARY OF THE INVENTION

Accordingly, for solving this problem of the existing device, an object of the exemplary embodiment of the present invention is to provide an antenna device that with improved load bearing capability of the antenna case while suppressing the increase of resin amount of the antenna case.

To achieve the above objective, an antenna device is provided that includes an antenna coil, a resin-made antenna case having a body for accommodating the antenna coil, and a rib formed on an upper surface of the body and on a pair of opposing side surfaces of the body.

In the exemplary antenna device, the rib is continuously formed from one of the side surfaces, across the upper surface, to the other one of the side surfaces, and both end portions of the rib are formed so as to be flush with a lower surface of the body or so as to protrude downward from the lower surface of the body. In addition, both end portions of the rib are configured to come into contact with an external member when the antenna device is mounted on the external member.

Thus, according to the exemplary embodiment, an antenna device is provided with improved load bearing capability of the antenna case while suppressing the increase of resin amount of the antenna case.

DETAILED DESCRIPTION OF EXEMPLARY EMBODIMENTS

Figure 1:
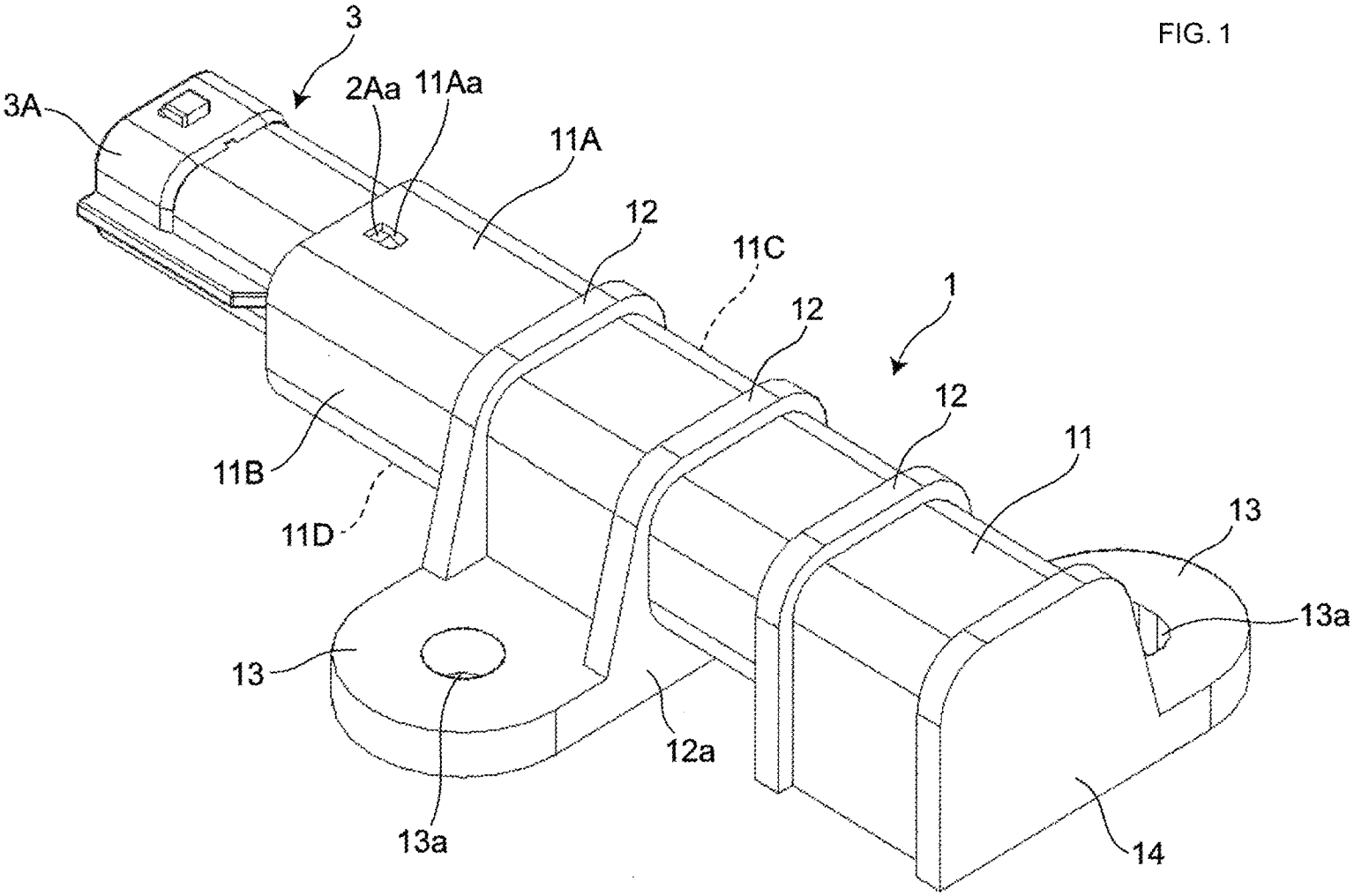
FIG. 1 is a perspective view schematically illustrating a configuration of an antenna device according to an exemplary embodiment.

An antenna device according to an exemplary aspect of the present invention includes an antenna coil, a resin-made antenna case having a body configured to accommodate the antenna coil, and a rib formed or otherwise disposed on an upper surface of the body and on a pair of opposing side surfaces of the body.

In the antenna device, the rib is continuously formed (e.g., extends) from one of the side surfaces, across the upper surface, to the other one of the side surfaces, and both end portions of the rib are formed so as to be flush with a lower surface of the body or so as to protrude downward from the lower surface of the body. In addition, both ends of the rib are configured to come into contact with an external member when the antenna device is mounted on the external member.

According to this configuration, the rib is continuously formed from one of the side surfaces of the body, across the upper surface, to the other side surface. As a result, the portions of the rib formed on respective surfaces reinforce each other and thereby increase the strength of the device. In addition, since the rib is also formed on the upper surface of the body, if, for example, the upper surface of body of the antenna device is stepped on, a foot comes into contact with the rib and applies a load onto the rib. Since the both end portions of the rib are formed so as to come into contact with the external member, the load applied to the rib can be transferred through the end portions of the rib to the contact surface. As a result, the load bearing capability of the antenna case can be improved while the increase of resin amount of the antenna case is suppressed.

According to an exemplary aspect, portions of the rib disposed on the side surfaces of the body can be formed so as to extend vertically or substantially vertically when the antenna device is mounted on the external member. With this configuration, the load applied to the rib can be transferred efficiently in the vertical direction to the contact surface. As a result, the load bearing capability of the antenna case is further improved while the increase of resin amount of the antenna case is further suppressed.

Moreover, the rib can be formed in a direction that orthogonally or substantially orthogonally intersects a longitudinal direction of the body. With this configuration, the length of the rib can be reduced and bending deformation of the rib can be suppressed. As a result, the load bearing capability of the antenna case is improved while the increase of resin amount of the antenna case is further suppressed.

A first reinforcement rib that connect the ends of the rib to each other can be formed on the lower surface of the body. This configuration suppresses the likelihood of the ends of the rib being damaged due to an excess load applied to the end portions of the rib. As a result, the load bearing capability of the antenna case is further improved.

In addition, a plurality of the ribs can be formed on the body so as to have a spacing between adjacent ribs. With this configuration, if, for example, the upper surface of body of the antenna device is stepped on, a foot comes into contact with the ribs in a straddling manner and applies a load to the ribs, which can reduce the amount of load applied to one rib. As a result, the load bearing capability of the antenna case can be further improved.

Moreover, a second reinforcement rib can be formed on the body so as to extend in a direction intersecting the ribs and to connect the ribs to each other. With this configuration, the load bearing capability of the antenna case is further improved.

Yet further, according to an additional aspect, a mounting portion can be formed on the body and can be attached to the external member in such a manner that a contact area of the both end portions to be in contact with the external member is expanded by joining the both end portions of the rib to the mounting portion. With this configuration, the load applied to the ends of the rib is distributed over the mounting portion, which reduces the likelihood of the end portions of the rib being damaged. As a result, the load bearing capability of the antenna case is further improved.

A through-hole through which the antenna coil can pass may be formed in one of side surfaces of the body that intersect the longitudinal direction of the antenna case. This enables the antenna coil to be inserted into the antenna case, which eliminates the necessity of providing a cavity in the upper surface or the side surfaces of the body on which the ribs are formed. This can further improve the load bearing capability of the antenna case.

Now, an exemplary embodiment of the present invention will be described with reference to the drawings. It is noted that the exemplary embodiment is not intended to limit the scope of the present invention. In the drawings, components that are substantially the same are denoted by the same reference symbols.

In the following description, terms related to directions, including "up" and "down", for example, are used for convenience of explanation on the basis of the orientation of the antenna device being assumed to be in the normal state of use. However, it should be appreciated that such terms do not limit the state of use or the like of the antenna device according to the present invention.

Figure 2:
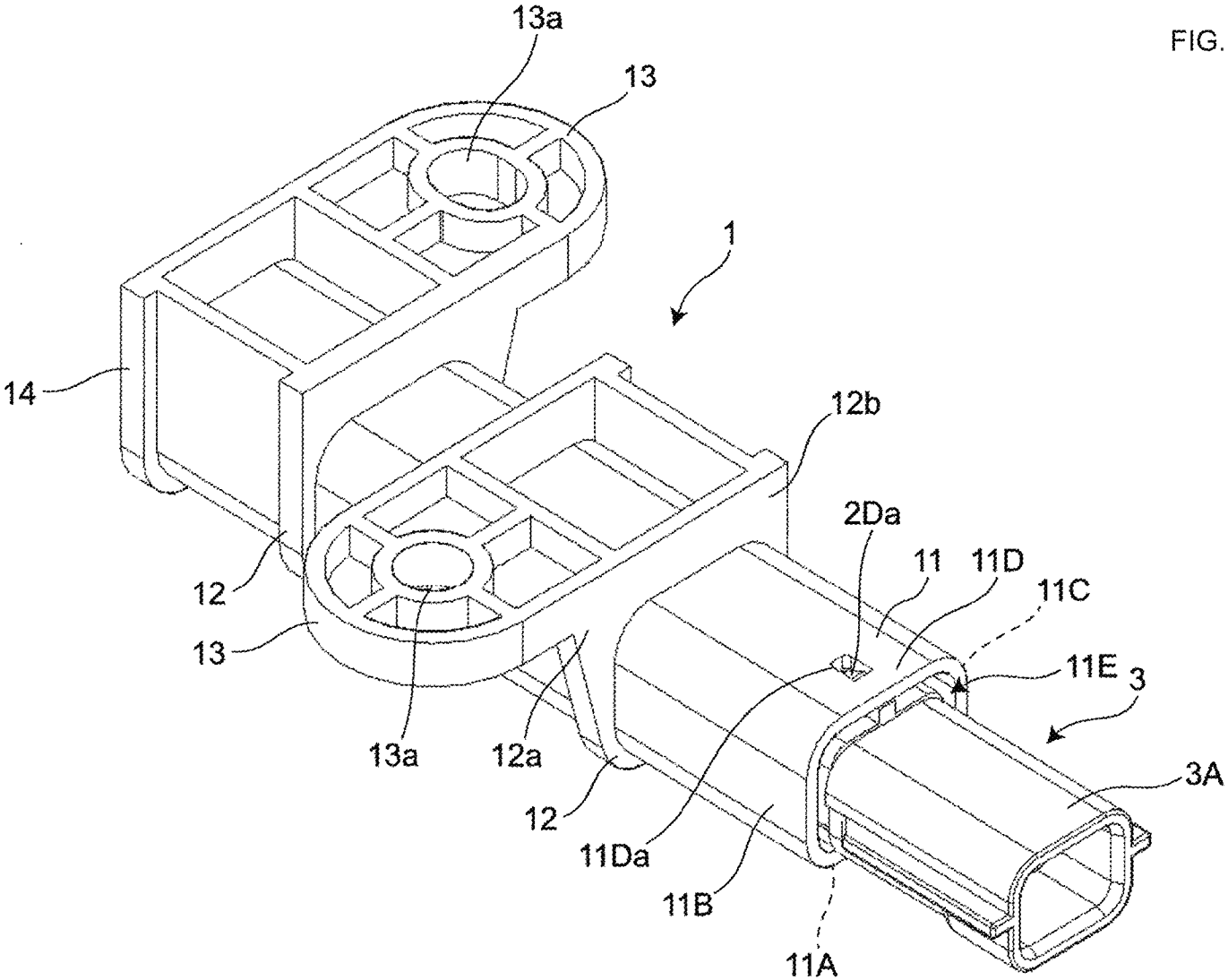
FIG. 2 is a perspective view schematically illustrating a configuration of the antenna device according to the exemplary embodiment.
Figure 3:
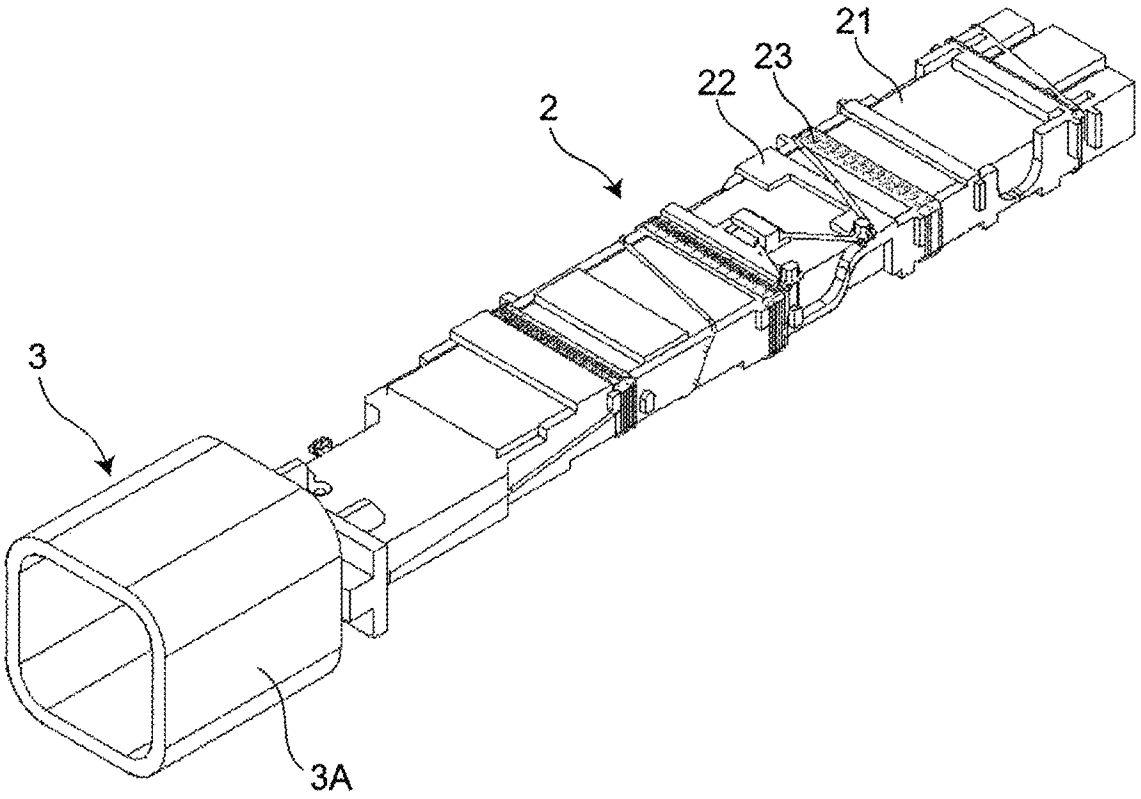
FIG. 3 is a perspective view schematically illustrating a configuration of an antenna coil and connector included in the antenna device illustrated in FIGS. 1 and 2.
Figure 4:
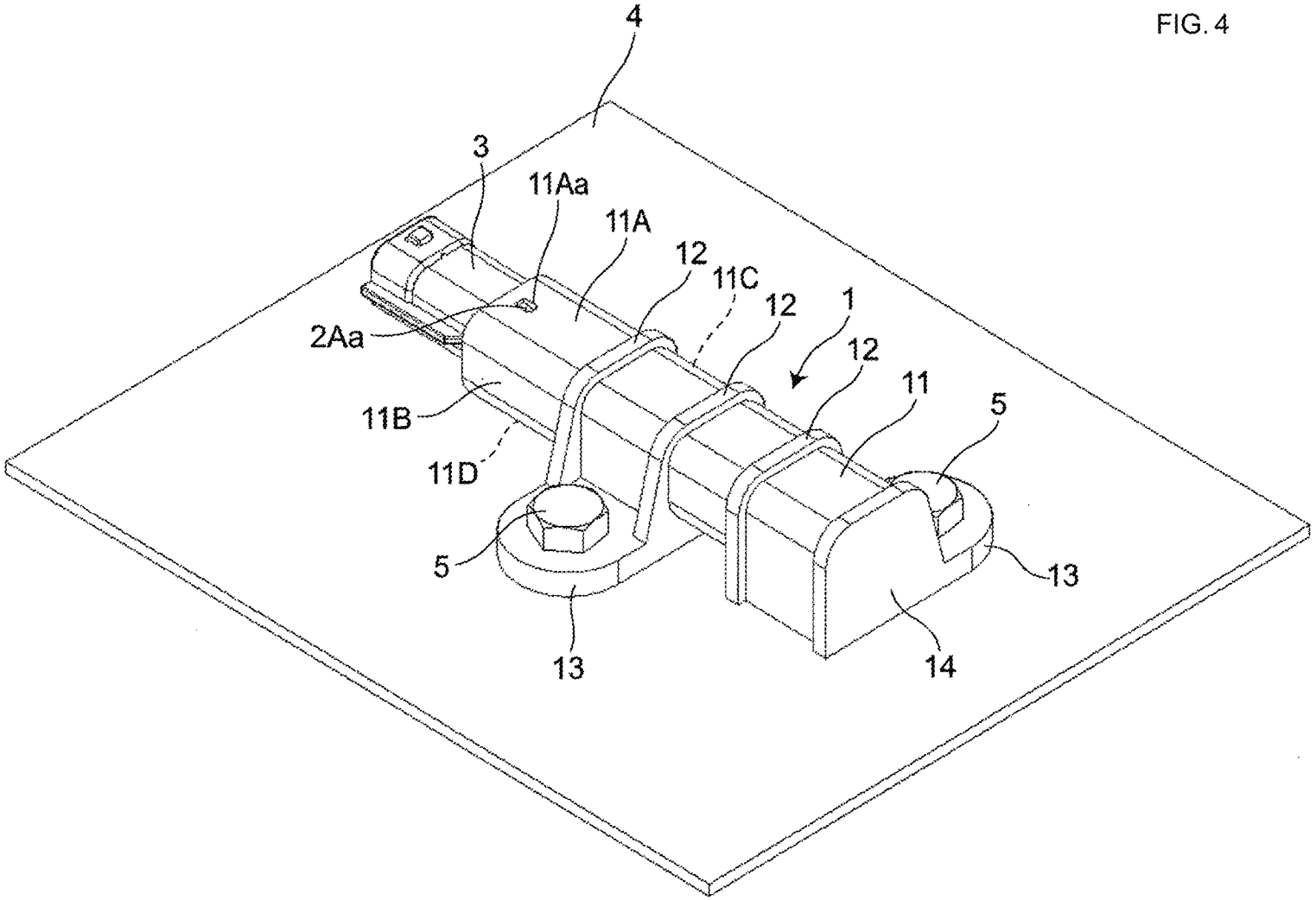
FIG. 4 is a perspective view illustrating a state in which the antenna device of FIG. 1 is mounted on an external member.

FIG. 1 is a perspective view schematically illustrating a configuration of an antenna device according to an exemplary embodiment of the present invention as viewed obliquely from above. FIG. 2 is a perspective view schematically illustrating a configuration of the antenna device according to the exemplary embodiment of the present invention as viewed obliquely from below. FIG. 3 is a perspective view schematically illustrating a configuration of an antenna coil and connector included in the antenna device illustrated in FIGS. 1 and 2. FIG. 4 is a perspective view illustrating a state in which the antenna device of FIG. 1 is mounted on an external member.

In general, the antenna device according to the exemplary embodiment is used, for example, as an antenna device for a smart keyless system or the like to be mounted on a vehicle. In an exemplary aspect, the antenna device can be mounted on a vehicle, for example, at a position under a seat or under a trunk.

As illustrated in any one of FIGS. 1 to 3, the antenna device according to the present embodiment includes a resin-made antenna case 1, an antenna coil 2 accommodated in the antenna case 1, and a connector 3 connected to one end of the antenna coil 2.

The antenna case 1 includes a body 11 that is shaped like a rectangular pipe in the present embodiment. The body 11 has an upper surface 11A, a pair of side surfaces 11B and 11C that oppose each other, and a lower surface 11D.

Moreover, a rib 12 that is shaped so as to protrude outward is formed on the upper surface 11A and the side surfaces 11B and 11C of the body 11. The rib 12 is continuously formed from the side surface 11B, across the upper surface 11A, to the side surface 11C. In the present embodiment, the rib 12 is formed in a direction orthogonally or substantially orthogonally intersecting the longitudinal direction of the body 11. The rib 12 and the body 11 may be integrally molded.

In the present embodiment, multiple ribs 12 are formed or otherwise disposed with a spacing provided between adjacent ribs 12. The spacing between adjacent ribs 12 may be, for example, 10 mm or less.

Both ends (i.e., both bottom end portions) 12*a* and 12*b* of each rib 12 (see, e.g., FIG. 2) are formed so as to come into contact with an external member when the antenna device is mounted on the external member. In the present embodiment, the end portions 12*a* and 12*b* of each rib 12 are formed so as to protrude downward further from the lower surface 11D of the body 11 and are joined to a mounting portion 13 formed on the lower surface 11D of the antenna case 1.

As illustrated in FIG. 4, the mounting portion 13 is a component that is configured to be attached to an external member 4, such as a metal plate of a vehicle body. In the present embodiment, two mounting portions 13 are joined to the antenna case 1 at two positions. One of the mounting portions 13 is formed in a longitudinally middle portion of the body 11 so as to extend horizontally from the lower surface 11D and sideways from the side surface 11B. The other one of the mounting portions 13 is formed in a longitudinal end portion of the body 11 so as to extend horizontally from the lower surface 11D and sideways from the side surface 11C.

Each mounting portion 13 has a through-hole 13*a* that pierces the mounting portion 13 in the vertical direction. As illustrated in FIG. 4, the antenna device is attached to the external member 4 by screwing a fastening member 5, such as a bolt or screw, into the external member 4 through the through-hole 13*a*. The contact area in contact with the external member 4 is expanded by joining the end portions 12*a* and 12*b* of the ribs 12 to corresponding mounting portions 13. Moreover, portions of each rib 12 disposed on the side surfaces 11B and 11C of the body 11 are formed so as to extend vertically or substantially vertically when the antenna device is mounted on the external member 4.

The body 11 includes an end plate 14 disposed on one of the side surfaces of the antenna case 1 that intersect the longitudinal direction of the antenna case 1. The circumferential shape of the end plate 14 is formed so as to be the same as those of the ribs 12.

A through-hole 11E (see FIG. 2) is formed in the other one of the side surfaces of the body 11 that intersect the longitudinal direction of the antenna case 1. The through-hole 11E is formed such that the antenna coil 2 illustrated in FIG. 3 can pass through. The antenna coil 2 is inserted into the antenna case 1 through the through-hole 11E and is accommodated in the body 11 of the antenna case 1.

As illustrated in FIGS. 1 and 2, engagement holes 11Aa and 11Da are formed in the upper and lower surfaces 11A and 11D of the body 11, respectively, at positions near the through-hole 11E. Engagement pieces 2Aa and 2 Da, which are formed in the antenna coil 2, engage corresponding engagement holes 11Aa and 11Da, which causes the antenna coil 2 to be locked in the antenna case 1.

As illustrated in FIG. 3, the antenna coil 2 includes a rod-like core 21 made of a magnetic material, a bobbin 22 that accommodates the core 21, and a wire 23 wound around the bobbin 22.

The core 21 is a magnetic body that is inserted into the bobbin 22. In the present embodiment, the core 21 is a rod-like magnetic body having a rectangular cross section. The core 21 is made, for example, of a Mn—Zn based ferrite.

The bobbin 22 is a resin-made member that protects the core 21 and reduces the likelihood of the core 21 breaking due to deformation or impact occurring during manufacturing or using the product. The bobbin 22 has multiple openings through which the core 21 can be exposed at several locations.

For example, the wire 23 is made of a metal, such as copper. In the present embodiment, the wire 23 is helically wound around the bobbin 22 at multiple locations so as to form multiple coil portions.

The connector 3 has a resin-made tubular member 3A and a pair of connector pins (not illustrated) disposed inside the tubular member 3A. A pair of the connector pins are connection terminals connected to a circuit board. One end of the wire 23 is connected to one of the connector pins. The other end of the wire 23 is connected to the other one of the connector pins. Moreover, an inductor circuit can be formed by using the coil portion of the wire 23. One end or the other end of the wire 23 may be coupled through a capacitor (not illustrated) to one or the other one of the connector pins of the connector 3. An inductor-capacitor circuit can be formed by using the coil portion of the wire 23 and the capacitor.

In the present embodiment, the tubular member 3A and the bobbin 22 of the connector 3 are integrally molded from a resin, such as polybutylene terephthalate (PBT), for example. It is noted that the connector pins of the connector 3 may be formed by insert molding simultaneously when the tubular member 3A and the bobbin 22 of the connector 3 are integrally molded. Alternatively, the connector pins of the connector 3 may be formed by outsert molding after the tubular member 3A and the bobbin 22 of the connector 3 are integrally molded. Note that details of the connector 3 are omitted in FIG. 3.

In the antenna device according to the present embodiment, each rib 12 is formed continuously from the side surface 11B, across the upper surface 11A, to the side surface 11C of the body 11. As a result, the portions of each rib 12 formed on respective surfaces reinforce each other and thereby increase the strength. In addition, since the ribs 12 are also formed on the upper surface 11A of the body 11, if, for example, the upper surface of antenna case of the antenna device is stepped on, a foot comes into contact with the ribs 12 and applies a load onto the ribs 12. Since the both end portions 12*a* and 12*b* of each rib 12 are formed so as to come into contact with an external member, the load applied to each rib 12 can be transferred through the end portions 12*a* and 12*b* to the contact surface. As a result, the load bearing capability of the antenna case 1 can be improved while the increase of resin amount of the antenna case 1 is suppressed.

In the antenna device according to the present embodiment, the portions of each rib 12 disposed on the side surfaces 11B and 11C of the body 11 are formed so as to extend vertically or substantially vertically when the antenna device is mounted on the external member 4.

As a result, the load applied to each rib 12 can be transferred efficiently in the vertical direction to the contact surface. This can further improve the load bearing capability of the antenna case 1 while further suppressing the increase of resin amount of the antenna case 1.

Moreover, in the antenna device according to the present embodiment, each rib 12 is formed in a direction that orthogonally or substantially orthogonally intersects the longitudinal direction of the body 11. This configuration reduces the length of the rib 12 and also suppresses bending deformation of the rib 12. As a result, the load bearing capability of the antenna case 1 is improved while the increase of resin amount of the antenna case 1 is suppressed.

In the antenna device according to the present embodiment, multiple ribs 12 are formed on the body 11 with a spacing provided between adjacent ribs 12. Accordingly, if, for example, the upper surface 11A of body 11 of the antenna device is stepped on, a foot comes into contact with multiple ribs 12 in a straddling manner and applies a load to the multiple ribs 12, which reduces the amount of load applied to one rib 12. As a result, the load bearing capability of the antenna case 1 can be further improved.

In the antenna device according to the present embodiment, the contact area to be in contact with the external member 4 is expanded by joining the end portions 12*a* and 12*b* of the ribs 12 to corresponding mounting portions 13. The load applied to the end portions 12*a* and 12*b* of the ribs 12 is distributed over the mounting portions 13, which reduces the likelihood of the end portions 12*a* and 12*b* of each rib 12 being damaged. As a result, the load bearing capability of the antenna case 1 can be further improved.

In the antenna device according to the present embodiment, the through-hole 11E is formed in one of the side surfaces of the body 11 that intersect the longitudinal direction of the antenna case 1. The through-hole 11E is formed such that the antenna coil 2 can pass through. This enables the antenna coil 2 to be inserted into the antenna case 1, which eliminates the necessity of providing a cavity in the upper surface 11A or the side surface 11B or 11C of the body 11 on which the ribs 12 are formed. As a result, the load bearing capability of the antenna case 1 can be further improved.

Figure 5:
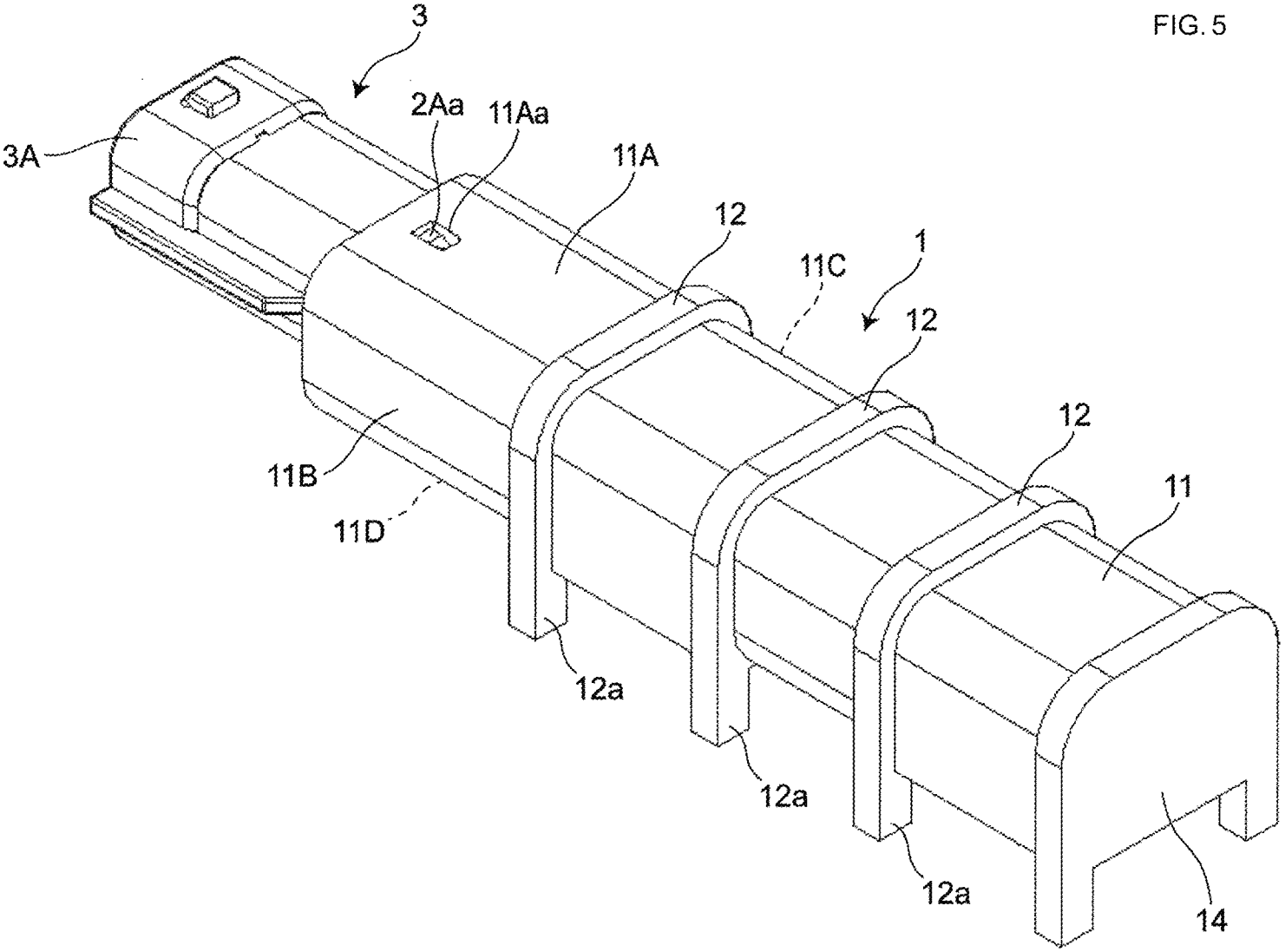
FIG. 5 is a perspective view illustrating a first modification example of the antenna device of FIG. 1.
Figure 6:
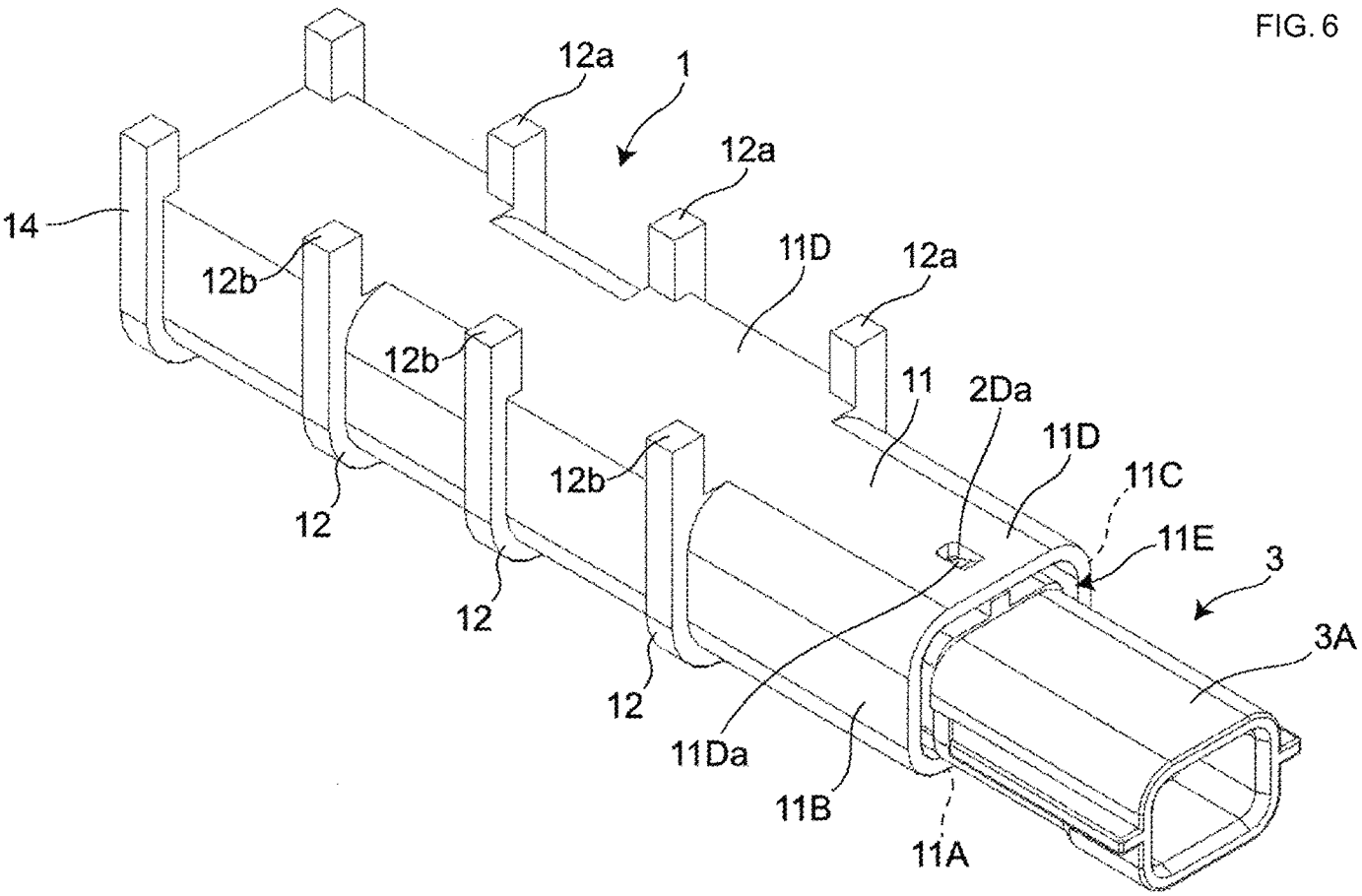
FIG. 6 is another perspective view illustrating the first modification example of the antenna device of FIG. 1.

It is noted that the exemplary embodiment of the present invention is not limited to the above-described embodiment but can be implemented in various other forms. For example, as described above, the end portions 12*a* and 12*b* of the ribs 12 are joined to corresponding mounting portions 13. However, the present invention is not limited to this configuration. It is sufficient that the end portions 12*a* and 12*b* of the ribs 12 are at least configured to be in contact with the external member 4 when the antenna device is mounted on the external member 4. For example, as illustrated in FIGS. 5 and 6, the end portions 12*a* and 12*b* of the ribs 12 can be formed so as to protrude further downward from the lower surface 11D of the body 11. Alternatively, if the lower surface 11D of the body 11 serves as the contact surface, the end portions 12*a* and 12*b* of the ribs 12 can be formed so as to be flush with the lower surface 11D of the body 11.

Figure 7:
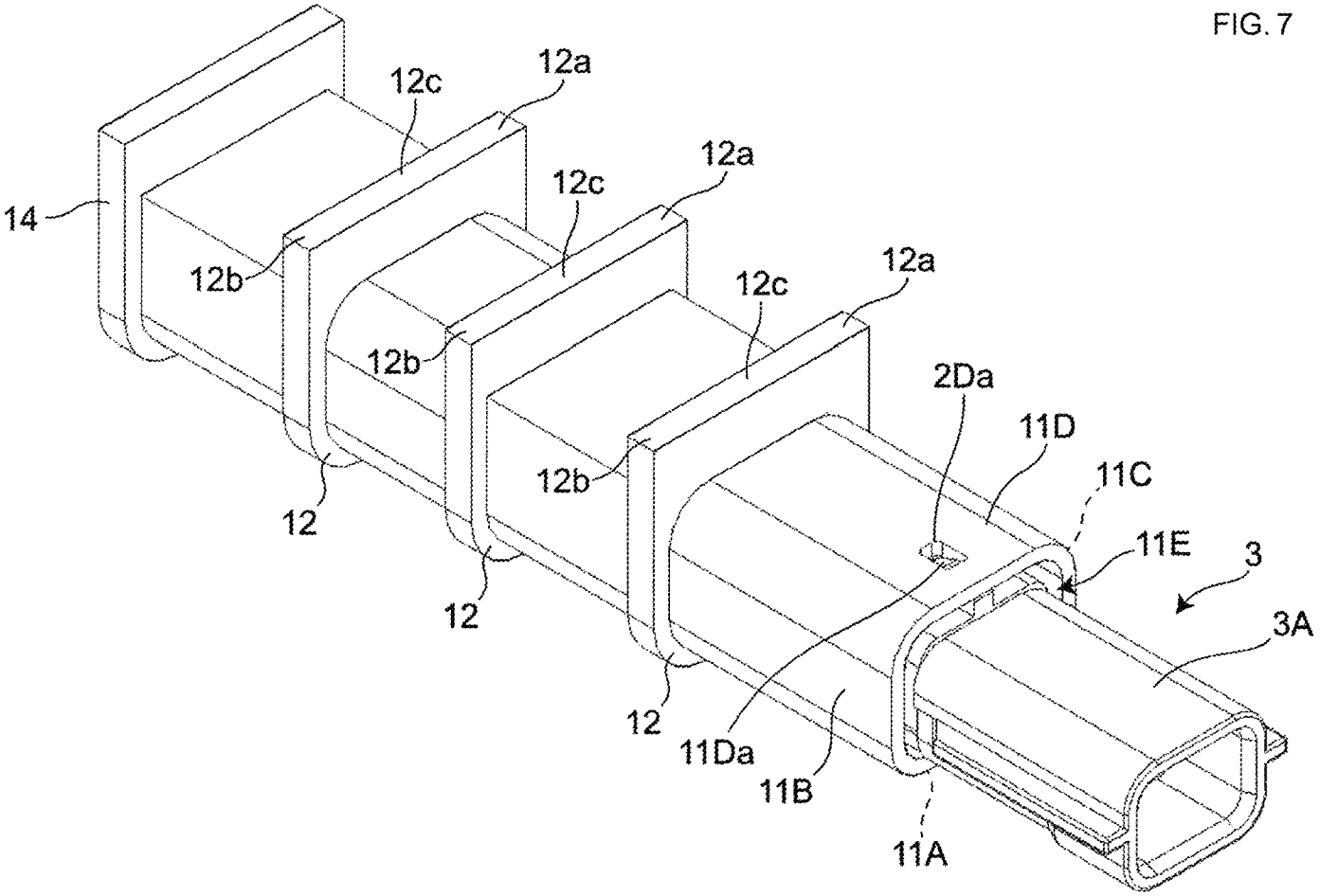
FIG. 7 is a perspective view illustrating a second modification example of the antenna device of FIG. 1.

In addition, as illustrated in FIG. 7, a first reinforcement rib 12*c* can be formed on the lower surface 11D of the body 11 so as to connect the end portions 12*a* and 12*b* of each rib 12. In other words, each rib can be formed so as to circumferentially surround the body 11. Moreover, the rib 12 and the first reinforcement rib 12*c* can be integrally molded. This design reduces the likelihood the end portions 12*a* and 12*b* of each rib 12 being damaged due to an excess load applied to the end portions 12*a* and 12*b* of the rib 12. As a result, the load bearing capability of the antenna case 1 can be further improved. It is also noted that the entire lower surface of the first reinforcement rib 12*c* need not be in contact with the external member 4 when the antenna device is mounted on the external member 4. For example, the first reinforcement rib 12*c* can be formed such that part of the first reinforcement rib 12*c* comes into contact with the external member 4.

Figure 8:
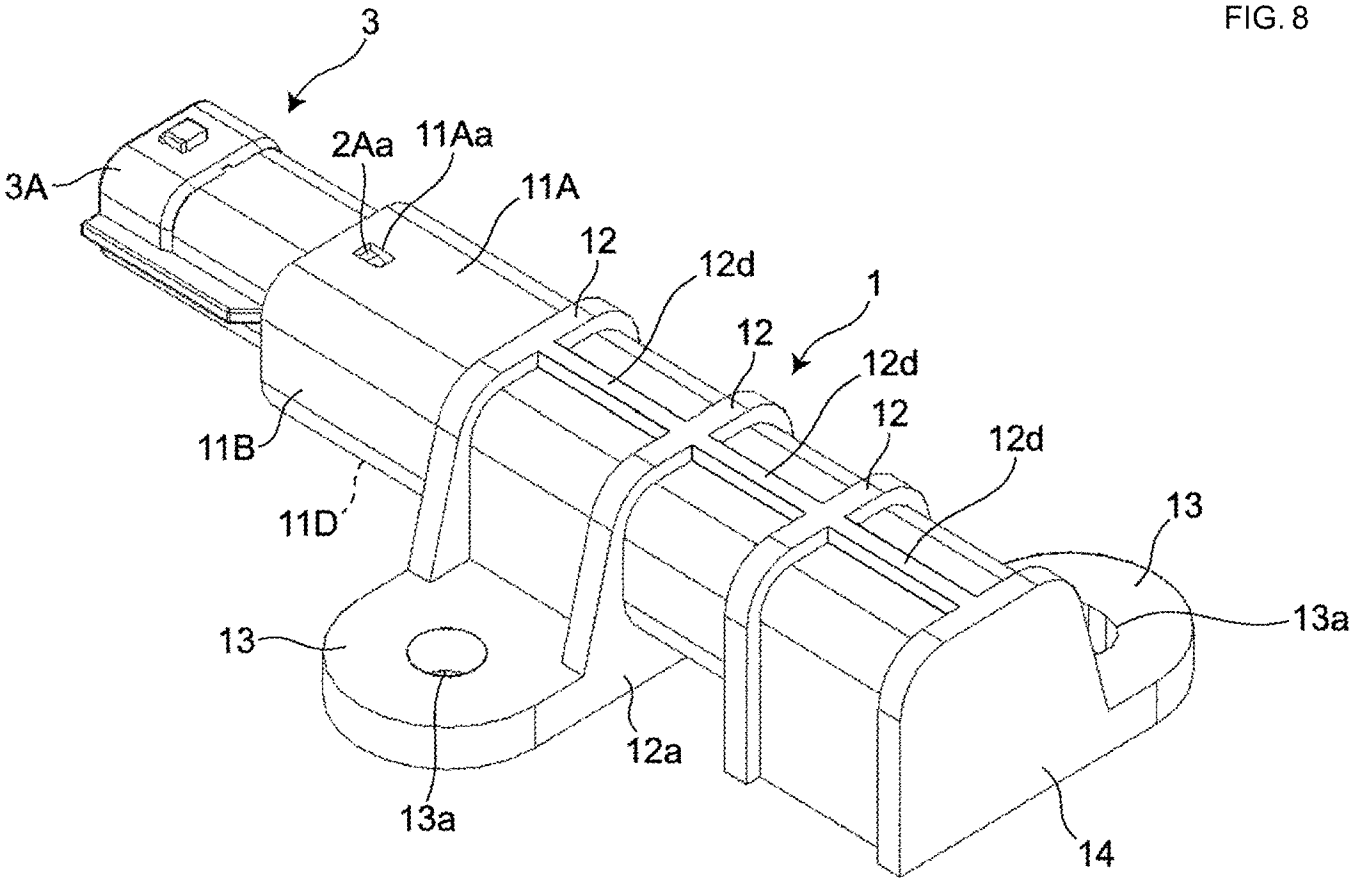
FIG. 8 is a perspective view illustrating a third modification example of the antenna device of FIG. 1.

As illustrated in FIG. 8, a second reinforcement rib 12*d* can also be formed on the body 11 so as to extend in a direction intersecting the ribs 12 and thereby connect multiple ribs 12. In addition, the ribs 12 and the second reinforcement rib 12*c* can be integrally molded. With this configuration, the load bearing capability of the antenna case 1 can be further improved.

As illustrated in the drawings, the upper surface 11A, the side surfaces 11B and 11C, and the lower surface 11D of the body 11 are flat or substantially flat surfaces. However, the present invention is not limited to this configuration. For example, the upper surface 11A, the side surfaces 11B and 11C, and the lower surface 11D of the body 11 can be formed as curved surfaces according to an alternative aspect.

Moreover, as illustrated in the drawings, the connection portions that connect adjacent surfaces of the body 11 are chamfered. However, the present invention is not limited to this configuration. The connection portions that connect adjacent surfaces of the body 11 may not be chamfered according to an alternative aspect.

As described above, the ribs 12 are formed in the direction intersecting the longitudinal direction of the body 11. However, the present invention is not limited to this configuration. The ribs 12 can be formed in a direction parallel to the longitudinal direction of the body 11.

As described above, a portion of each rib 12 on the upper surface 11A of the body 11 is formed linearly. However, the present invention is not limited to this configuration. It is sufficient that the portion of the rib 12 formed on the upper surface 11A of the body 11 is at least shaped so as to connect the side surfaces 11B and 11C.

In addition, as illustrated in the drawings, the ribs 12 are positioned highest on the entire upper surface 11A of the body 11. However, the present invention is not limited to this configuration. The ribs 12 formed on the upper surface 11A of the body 11 can be positioned highest only within a region in which a load is expectedly applied to the ribs 12 by a foot or the like when the antenna device is mounted on the external member 4. In other words, a portion of the body 11 located in a region in which a load is not expected may be positioned higher than the ribs 12.

In addition, the antenna coil 2 having the structure illustrated in FIG. 3 is used in the embodiment described above. However, the present invention is not limited to this configuration. The antenna coil 2 can be any one of antenna coils having various structures insofar as the antenna coil can be accommodated in the antenna case 1.

The antenna device according to the present invention can improve the load bearing capability of the antenna case while suppressing the increase of resin amount of the antenna case. Accordingly, the antenna device is useful as, for example, a vehicle-mounted antenna device for a smart keyless system or the like.

REFERENCE SIGNS LIST

1 antenna case
2 antenna coil
2Aa, 2Da engagement piece
3 connector
3A tubular member
4 external member
5 fastening member
11 body
11A upper surface
11Aa engagement hole
11B, 11C side surface
11D lower surface
11Da engagement hole
11E through-hole
12 rib
12*a*, 12*b* end portion
12*c* first reinforcement rib
12*d* second reinforcement rib
13 mounting portion
13*a* through-hole
14 end plate
21 core
22 bobbin
23 wire

The invention claimed is:

1. An antenna device comprising:
an antenna coil;
an antenna case formed from resin and having a body configured to accommodate the antenna coil; and
a rib disposed on an upper surface of the body and on a pair of opposing side surfaces of the body,
wherein the rib is continuously formed from a first side surface of the side surfaces, across the upper surface, to a second side surface of the side surfaces,
wherein both ends of the rib are flush with a lower surface of the body or protrude downward from the lower surface of the body, and
wherein the both ends of the rib are configured to come into contact with an external member when the antenna device is mounted on the external member.

2. The antenna device according to claim 1, wherein the lower surface of the body opposes the upper surface of the body.

3. The antenna device according to claim 1, wherein portions of the rib disposed on the opposing side surfaces of the body extend vertically when the antenna device is mounted on the external member.

4. The antenna device according to claim 1, wherein portions of the rib disposed on the opposing side surfaces of the body extend substantially vertically when the antenna device is mounted on the external member.

5. The antenna device according to claim 1, wherein the rib extends in a direction that orthogonally intersects a longitudinal direction of the body.

6. The antenna device according to claim 1, wherein the rib extends in a direction that substantially orthogonally intersects a longitudinal direction of the body.

7. The antenna device according to claim 1, further comprising a first reinforcement rib that is coupled to the both ends of the rib and disposed on the lower surface of the body.

8. The antenna device according to claim 7, wherein at least part of the first reinforcement rib is configured to contact the external member when the antenna device is mounted on the external member.

9. The antenna device according to claim 1, further comprising a plurality of ribs disposed on the body with a spacing between adjacent ribs.

10. The antenna device according to claim 9, further comprising a second reinforcement rib disposed on the body so as to extend in a direction intersecting the plurality of ribs and that connects the plurality of ribs to each other.

11. The antenna device according to claim 1, further comprising a mounting portion disposed on the body and configured to be attached to the external member.

12. The antenna device according to claim 11, wherein the mounting portion is configured such that a contact area expands for the both ends that are configured to contact the external member by joining the both ends of the rib to the mounting portion.

13. The antenna device according to claim 11, wherein the both ends of the rib are continuously formed with the mounting portion.

14. The antenna device according to claim 1, further comprising a through-hole through configured to receive the antenna coil and that is disposed in one of the opposing side surfaces of the body that intersects a longitudinal direction of the antenna case.

15. The antenna device according to claim 1, wherein the external member is a metal plate of a vehicle body.

16. The antenna device according to claim 1, wherein the antenna coil comprises a magnetic core, a bobbin configured to accommodate the magnetic core, and a wire wound around the bobbin.

17. The antenna device according to claim 16, wherein the bobbin comprises a plurality of openings through which the magnetic core is exposed.

18. The antenna device according to claim 1, wherein the upper and lower surfaces of the body each have at least one engagement hole and the antenna coil has a plurality of corresponding engagement members configured to engage the respective engagement holes when the antenna coil is inserted in the body.

19. The antenna device according to claim 1, wherein the body of the antenna case includes an end plate disposed opposite an opening of the body configured to accommodate the antenna coil, with the end plate extending in a direction that intersects a longitudinal direction of the antenna case.

20. The antenna device according to claim 19, wherein the end plate comprises a circumferential shape that is a same shape as the rib.

* * * * *